US008770577B2

(12) United States Patent
Onodera

(10) Patent No.: US 8,770,577 B2
(45) Date of Patent: Jul. 8, 2014

(54) SHEET CONVEYANCE APPARATUS AND IMAGE FORMING APPARATUS WITH LEVER MEMBER PROVIDED IN THE SHEET CONVEYANCE PATH

(71) Applicant: Canon Kabushiki Kaisha, Tokyo (JP)

(72) Inventor: Shinichi Onodera, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/722,730

(22) Filed: Dec. 20, 2012

(65) Prior Publication Data

US 2013/0161902 A1 Jun. 27, 2013

(30) Foreign Application Priority Data

Dec. 27, 2011 (JP) ..... 2011-286209

(51) Int. Cl.
*B65H 1/22* (2006.01)
*B65H 1/26* (2006.01)

(52) U.S. Cl.
CPC ..... *B65H 1/266* (2013.01)
USPC ..... 271/164; 399/124; 399/393; 109/73

(58) Field of Classification Search
USPC ..... 271/145, 164; 399/124, 393; 109/73
See application file for complete search history.

(56) References Cited

U.S. PATENT DOCUMENTS 5,383,655 A * 1/1995 Hayakawa et al. ..... 271/164
8,387,970 B2 * 3/2013 Ubayashi ..... 271/164

FOREIGN PATENT DOCUMENTS

JP 10-107940 A 4/1998
JP 2005-178942 A 7/2005
JP 2005178942 A * 7/2005
JP 2005-263375 A 9/2005
JP 2010-155710 A 7/2010

* cited by examiner

*Primary Examiner* — Gerald McClain
(74) *Attorney, Agent, or Firm* — Canon USA Inc. IP Division

(57) ABSTRACT

A sheet conveyance apparatus includes a sheet conveyance path provided in an apparatus main body and configured to convey a sheet, a jamming handling cover configured to be openable and closable and to expose the sheet conveyance path to an exterior by being opened, a unit configured to be able to be drawn out of the apparatus main body, a lever member provided in the sheet conveyance path and configured to rotate by contacting the sheet passing through the sheet conveyance path, and a stopper member configured to move to a restriction position to restrict the drawing-out of the unit, in conjunction with the rotation of the lever member.

6 Claims, 7 Drawing Sheets

SHEET CONVEYANCE APPARATUS AND IMAGE FORMING APPARATUS WITH LEVER MEMBER PROVIDED IN THE SHEET CONVEYANCE PATH

BACKGROUND OF THE INVENTION

1. Field of the Invention

The present invention relates to a sheet conveyance apparatus and to an image forming apparatus equipped with the sheet conveyance apparatus.

2. Description of the Related Art

Conventionally, in an image forming apparatus forming an image on a sheet, such as a printer, the sheet is fed from a feeding unit, and is conveyed along a sheet conveyance path. Then, an image is formed on the sheet, which is discharged. Herein, when conveying the sheet, the sheet may get stuck in the sheet conveyance path to cause a paper jam. When the paper jam occurs, it is necessary to perform jamming handling to remove the sheet which has caused the paper jam. Then, the user opens a jamming handling cover to expose the sheet conveyance path to the exterior, and performs jamming handling.

Japanese Patent Application Laid-Open No. 10-107940 discusses an image forming apparatus configured to display jamming handling operation procedures on an operation panel so that the user can smoothly perform the jamming handling.

However, when the user does not follow the jamming handling procedures displayed on the operation panel or when the jamming handling is performed in an improper manner, the sheet may suffer damage, with the result that the jamming handling takes time.

For example, when a paper jam occurs in a sheet while the sheet is being fed from a feeding cassette, jamming handling procedures are displayed to instruct the user to open the sheet conveyance path adjacent to the feeding cassette, and to remove the sheet that has jammed. However, if the user follows the erroneous jamming handling procedures and draws out the feeding cassette, the sheet may suffer damage. In particular, in the case where the feeding cassette drawing-out direction and the conveyance direction of the sheet from the feeding cassette cross each other, if the jammed sheet is stretched between the feeding cassette and the apparatus main body, the sheet will suffer damage such as rupture. Then, when the sheet thus suffers damage, a lot of time and effort is required of the user in performing the jamming handling.

In view of this, Japanese Patent Application Laid-Open No. 2005-263375 discusses an image forming apparatus equipped with a mechanism configured to restrict drawing-out of a feeding cassette so that the user is disabled to draw out the feeding cassette when a paper jam occurs in a sheet being fed from the feeding cassette.

The image forming apparatus discussed in Japanese Patent Application Laid-Open No. 2005-263375 is equipped with a mechanism configured to electrically restrict the drawing-out of the feeding cassette based on the detection result of a sheet detection sensor configured to detect a residual sheet in a sheet conveyance path.

However, the image forming apparatus discussed in Japanese Patent Application Laid-Open No. 2005-263375 leaves room for an improvement. That is, the image forming apparatus discussed in Japanese Patent Application Laid-Open No. 2005-263375 is equipped with the mechanism configured to electrically restrict the drawing-out of the feeding cassette, so that, when the power of the apparatus main body is OFF, the feeding cassette may be drawn out by the user.

Then, when the user follows the erroneous jamming handling procedures and draws out the feeding cassette, the sheet may suffer damage.

SUMMARY OF THE INVENTION

The present invention is directed to a sheet conveyance apparatus capable of preventing the sheet from being damaged due to the user following the wrong procedures in performing jamming handling even when the power of the apparatus main body is OFF.

According to an aspect of the present invention, a sheet conveyance apparatus includes a sheet conveyance path provided in an apparatus main body and configured to convey a sheet, a jamming handling cover configured to be openable and closable and to expose the sheet conveyance path to an exterior by being opened, a unit configured to be able to be drawn out of the apparatus main body, a lever member provided in the sheet conveyance path and configured to rotate by contacting the sheet passing through the sheet conveyance path, and a stopper member configured to move to a restriction position to restrict the drawing-out of the unit, in conjunction with the rotation of the lever member.

According to an exemplary embodiment of the present invention, the drawing-out of the unit is restricted by the stopper member configured to move in conjunction with the lever member configured to rotate by contacting the sheet passing through the sheet conveyance path. Accordingly, even when the power of the apparatus main body is OFF, it is possible to prevent damage of the sheet due to the user erroneously drawing out the unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 2:
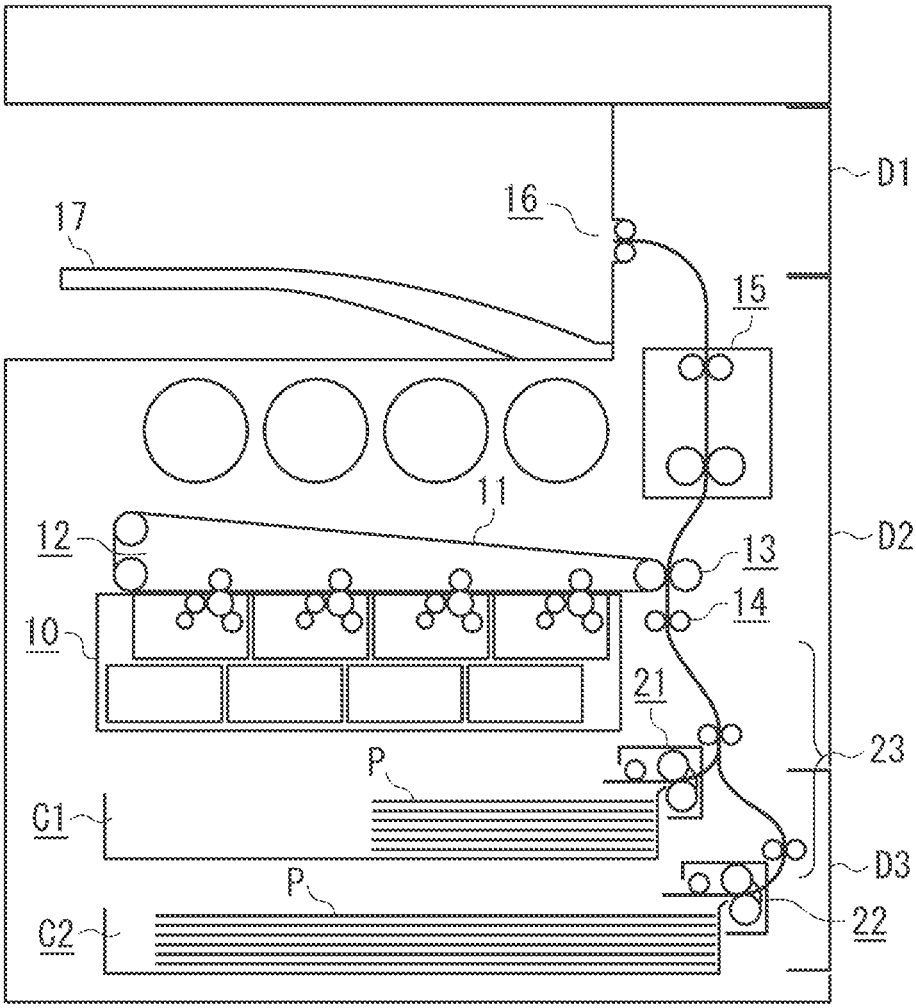
FIG. 2 illustrates the overall construction of an image forming apparatus according to the exemplary embodiment of the present invention.

FIG. 2 is a schematic sectional view illustrating a color digital printer as an example of an image forming apparatus to which a sheet conveyance apparatus is applied according to an exemplary embodiment of the present invention.

First, an image forming unit according to the present exemplary embodiment will be described. In the full-color digital printer illustrated in FIG. 2, toner images are formed by an image forming unit 10 configured to perform an operation from laser exposure to toner image formation for each of the following colors: yellow, magenta, cyan, and black. A primary transfer unit 12 primarily transfers the toner images formed onto a transfer belt 11 in a state in which the toner images are superimposed one upon the other. A secondary transfer unit 13 secondarily transfers the images on the transfer belt 11 to a sheet. Feeding cassettes C1 and C2 constitute a unit that can be drawn out of the apparatus main body. A sheet P stored in the feeding cassette C1 or C2 is fed by a feeding unit 21 or 22, respectively, and is conveyed by a conveyance unit 23. The sheet conveyed by the conveyance unit 23 is controlled in attitude and position by a registration unit 14, and is conveyed to the secondary transfer unit 13 in synchronism with the toner image on the transfer belt 11. After that, the sheet to which the image has been transferred by the secondary transfer unit 13 undergoes image fixing at a fixing unit 15, and is discharged to the exterior of the apparatus by a discharge unit 16. The discharged sheet is stacked on a stacking tray 17.

Figure 3A:
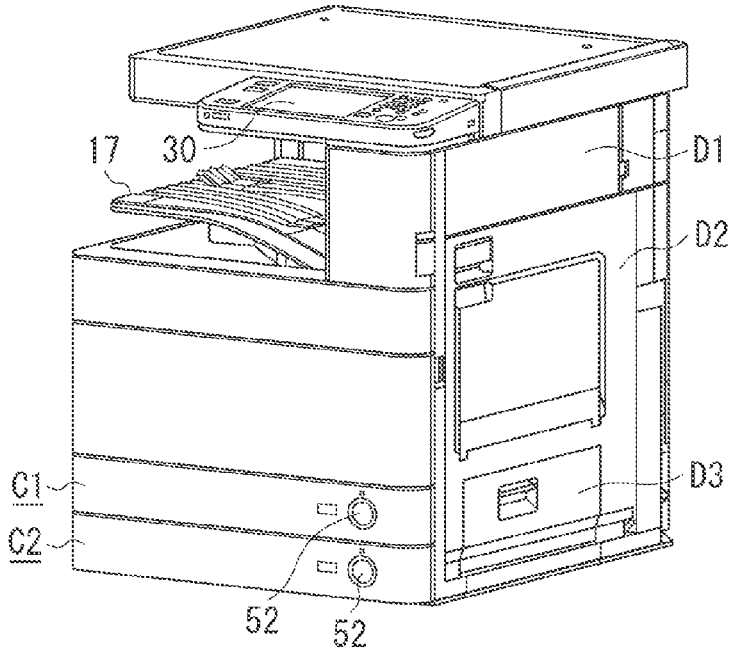
FIGS. 3A and 3B are diagrams each illustrating the overall construction of the image forming apparatus according to the exemplary embodiment of the present invention.

FIG. 3A illustrates the outward appearance of the image forming apparatus according to the present exemplary embodiment. An operation display panel 30 displays various items of information such as operational status of the apparatus and consumption conditions of consumables.

The feeding cassettes C1 and C2 are supported by the image forming apparatus so as to be capable of being drawn out by sliding in the forward direction of the apparatus when the feeding cassettes C1 and C2 are to be replenished with sheets to be stored therein. By pressing release buttons 52, the feeding cassettes C1 and C2 can be drawn out. Further, by drawing out the feeding cassettes C1 and C2, it is also possible to open the conveyance path in the vicinity of the feeding units 21 and 22.

Further, the image forming apparatus according to the present exemplary embodiment has doors D1, D2, and D3 as jamming handling covers provided to be openable and closable, and configured to expose the sheet conveyance path by being opened. The doors D1, D2, and D3 constitute a part of the exterior of the apparatus main body, with their inner surfaces forming a part of the sheet conveyance path. The doors D1, D2, and D3 can be individually opened to remove any jammed sheet.

Figure 3B:
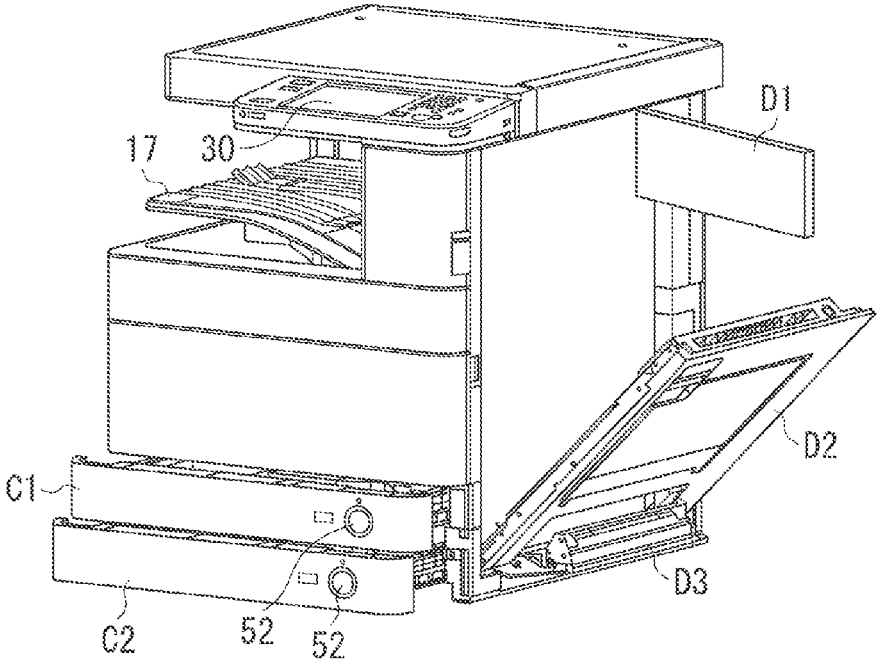

In the present exemplary embodiment, when a paper jam occurs, the sheets that can be discharged are automatically discharged to the exterior of the apparatus, and then the sheet conveyance operation is stopped, with any sheet that cannot be automatically discharged, for example, that is stuck on the downstream side in the sheet conveyance direction, being allowed to remain in the sheet conveyance path. Then, as illustrated in FIG. 3B, the doors D1, D2, and D3 are opened to expose the sheet conveyance path to the exterior, which makes it possible to remove the sheet that has got stuck. At this time, displayed on the operation display panel 30 are jamming handling procedures such as which door is to be opened to expose the sheet conveyance path according to the position of the sheet remaining in the sheet conveyance path. That is, while FIG. 3B illustrates the state in which all of the doors D1, D2, and D3 are open, the operation display panel 30 displays the jamming handling procedures such that the door needed for the jamming handling is opened.

Figure 4:
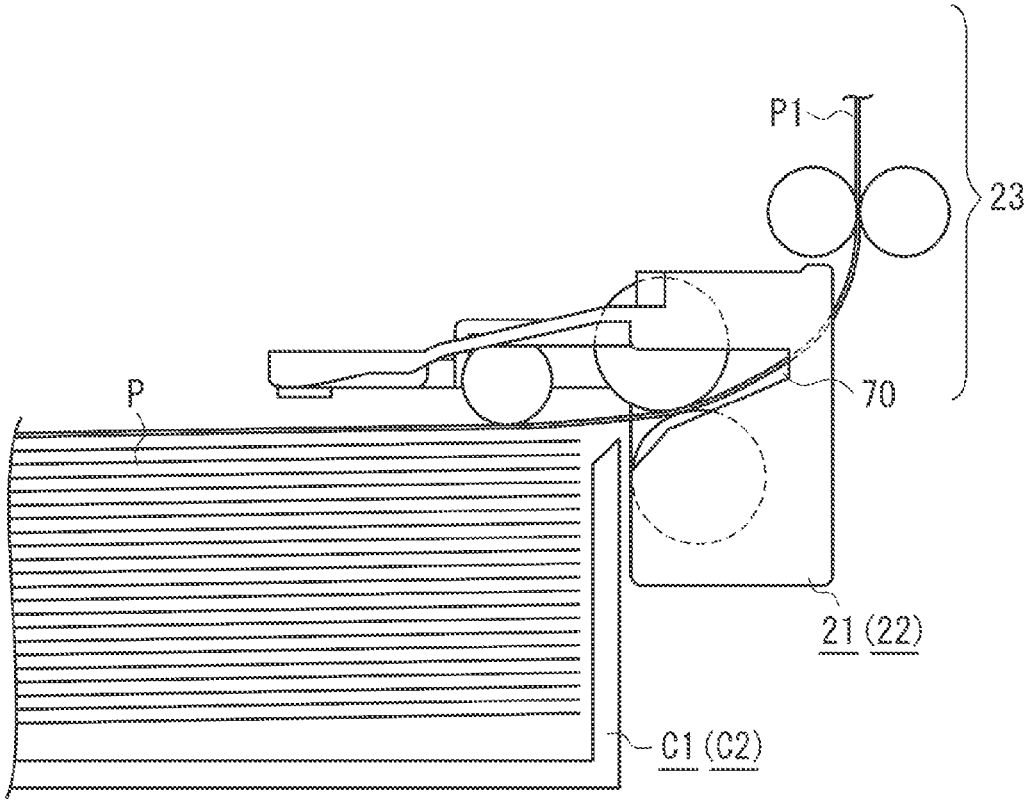
FIG. 4 is a schematic sectional view of the sheet conveyance apparatus according to the exemplary embodiment of the present invention.

Each of the feeding units 21 and 22 is provided with a cutout portion 70 so that the sheet can be drawn out of the apparatus together with the feeding cassette C1 or C2 even when the apparatus is at rest, with the leading edge of the sheet sticking out of the feeding cassette C1 or C2. However, as illustrated in FIG. 4, there are cases where the leading edge of the remaining sheet P1 extends beyond the cutout portion 70, with the sheet as a whole stretching over the feeding cassette C1 or C2 and the conveyance unit 23. In such cases, when the feeding cassette C1 or C2 is drawn out, the sheet is torn apart to remain within the apparatus, resulting in elongation of the jamming handling time or damage of the apparatus. Thus, when the remaining sheet stretches over the feeding cassette C1 or C2 and the conveyance unit 23, it is necessary to first open the door D2 or the door D3 to remove the remaining sheet.

In the present exemplary embodiment, there is provided a restriction mechanism configured to restrict the drawing-out of the feeding cassette C1 or C2 when the remaining sheet stretches over the feeding cassette C1 or C2 and the conveyance unit 23. Accordingly, even when the operator does not follow the jamming handling procedures, or when the power of the apparatus is OFF, it is possible to prevent trouble generated by erroneously drawing out the feeding cassette C1 or C2.

First, a mechanism for attaching and drawing the feeding cassettes C1 and C2 to and out of the apparatus main body will be described with reference to FIGS. 5A and 5B. The feeding cassettes C1 and C2 are of the same construction, so that, herein, solely the mechanism will be described for attaching and drawing the feeding cassette C1 to and out of the apparatus main body.

Figure 5A:
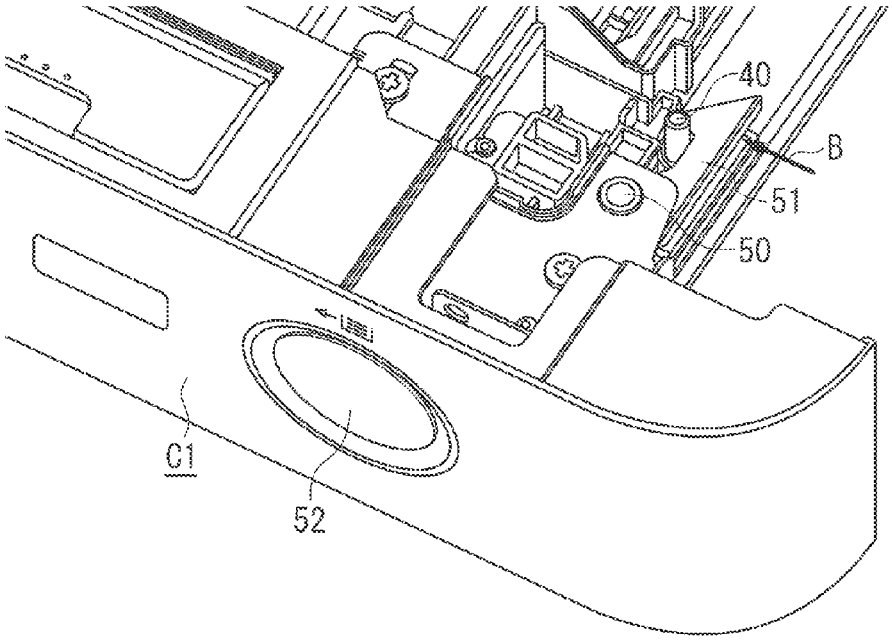
FIGS. 5A and 5B are diagrams each illustrating an example of the sheet conveyance apparatus according to the exemplary embodiment of present invention.

As illustrated in FIG. 5A, the feeding cassette C1 includes a latch lever 51 rotatably supported by a shaft 50 provided in the feeding cassette C1, and the latch lever 51 is urged in the direction of the arrow B by an urging unit (not illustrated). The latch lever 51 is engaged by latching with a positioning member 40 provided in the apparatus main body, whereby the feeding cassette C1 is set in position and locked with respect to the apparatus main body.

Figure 5B:
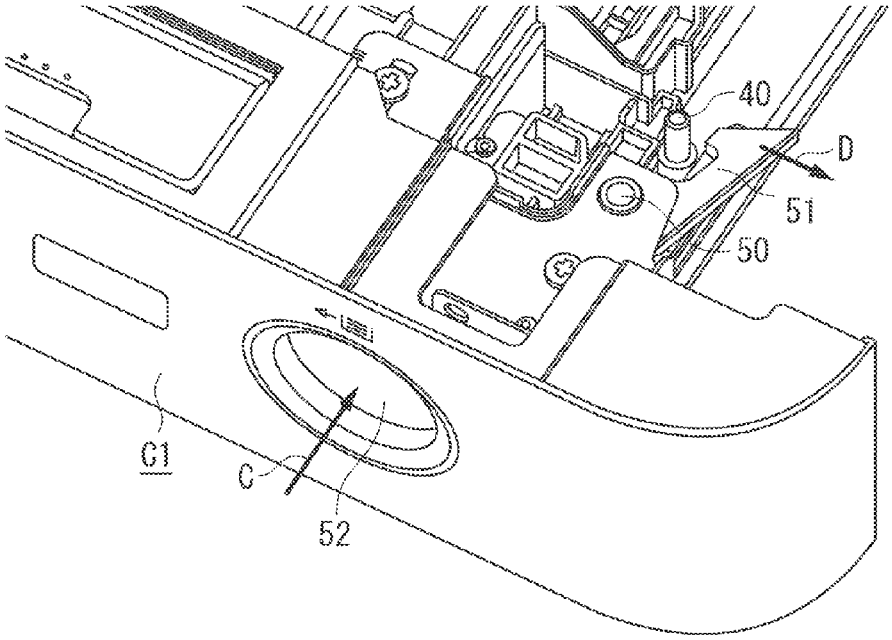

On the other hand, when drawing the feeding cassette C1 out of the apparatus main body, a release button 52 is pressed in the direction of the arrow C as illustrated in FIG. 5B, whereby the latch lever 51 is rotated in the direction of the arrow D via a link mechanism (not illustrated). Then, the engagement between the latch lever 51 and the positioning member 40 is released, whereby the lock is released. At this time, the feeding cassette C1 is pushed out in the drawing-out direction by a compression spring (not illustrated). The feeding cassette C1 is drawn out in the direction crossing the direction in which the sheet from the feeding cassette C1 is fed.

Figure 1:
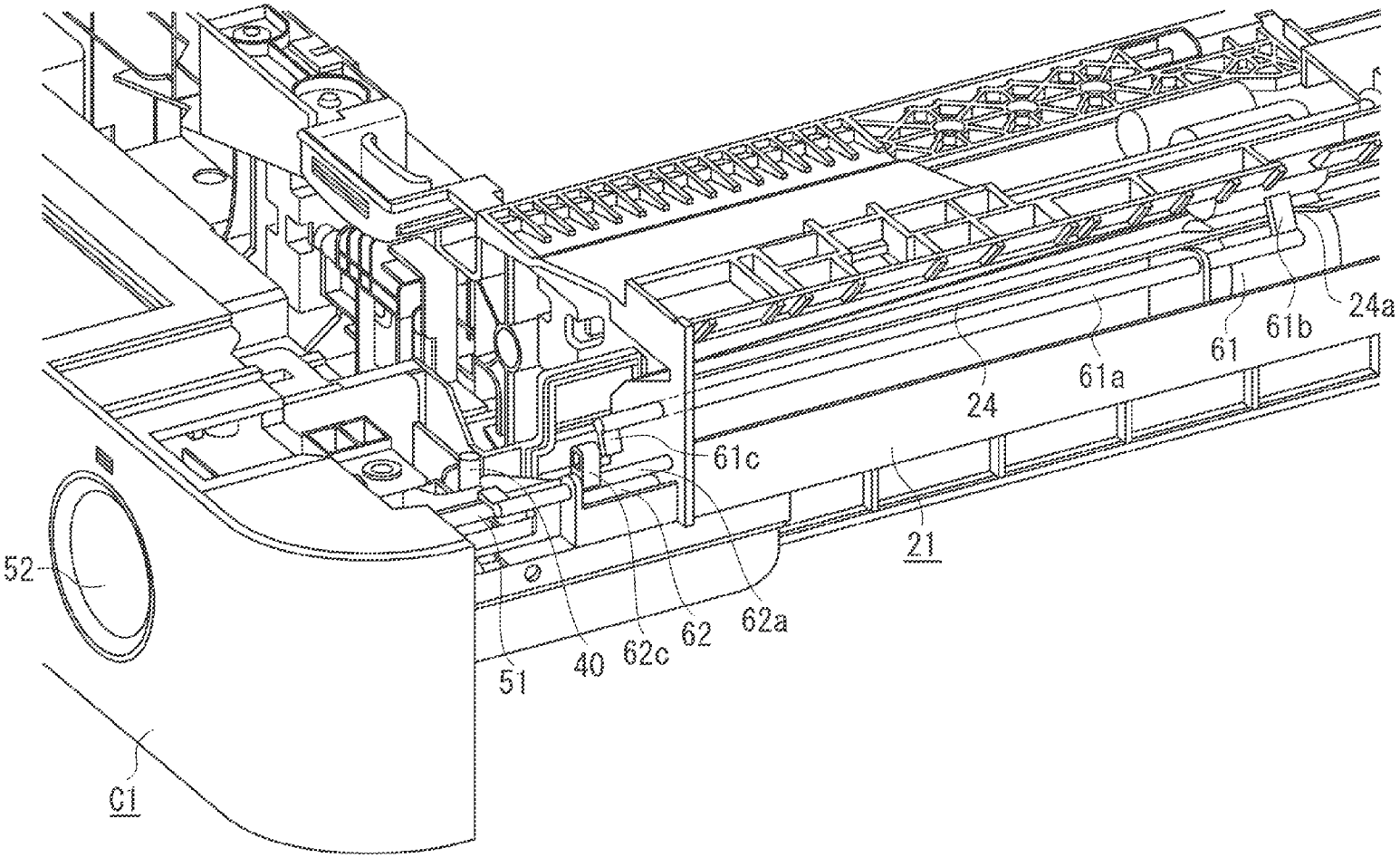
FIG. 1 is a diagram illustrating an example of a sheet conveyance apparatus according to an exemplary embodiment of the present invention.

Next, the restriction mechanism for restricting the drawing-out of the feeding cassette C1 will be described with reference to FIG. 1, which is a perspective view of the feeding unit 21, and FIG. 6, which is a sectional view thereof. As illustrated in FIG. 1, the restriction mechanism according to the present exemplary embodiment includes a lever member 61 provided in the sheet conveyance path within the apparatus main body, and a stopper member 62 link-connected with the lever member 61. The lever member 61 and the stopper member 62 are respectively supported by shaft portions 61*a* and 62*a* to be rotatable around the axes of the shaft portions 61*a* and 62*a*. The lever member 61 is provided with a lever portion 61*b* protruding into the sheet conveyance path. A connection portion 61*c* for connection with the stopper member 62 is provided at an end portion in the axial direction of the lever member 61. The stopper member 62 has an elongated-hole-like portion 62*c* into which the protrusion of the connection portion 61*c* with the stopper member 62 is inserted. A stopper portion 62*b* that can contact the latch lever 51 is provided at an end portion of the stopper member 62. The stopper member 62 is provided to be rotatable between a restriction release position where the drawing-out of the feeding cassette C1 is not restricted and a restriction position where the drawing-out of the feeding cassette C1 is restricted.

Due to this construction, the lever portion 61*b* of the lever member 61 rotates while contacting the sheet passing through the sheet conveyance path. The stopper member 62 moves, in conjunction with the rotation of the lever member 61, to the restriction position where the drawing-out of the feeding cassette C1 is restricted by the stopper portion 62*b*. This restriction position of the stopper portion 62*b* is the position where the latch lever 51 restricts the movement in the direction D in FIG. 5B. In the case where the stopper portion 62*b* is moved to this position, it is impossible to release the engagement between the latch lever 51 and the positioning member 40. Thus, even when the release button 52 is pressed, the feeding cassette C1 cannot be drawn out. When the sheet that has been stuck is removed by the user, the stopper member 51, which is urged by the urging unit (not illustrated), is rotated from the restriction position to the restriction release position, and the restriction of the latch lever 51 by the stopper member 62 is released.

Figure 6A:
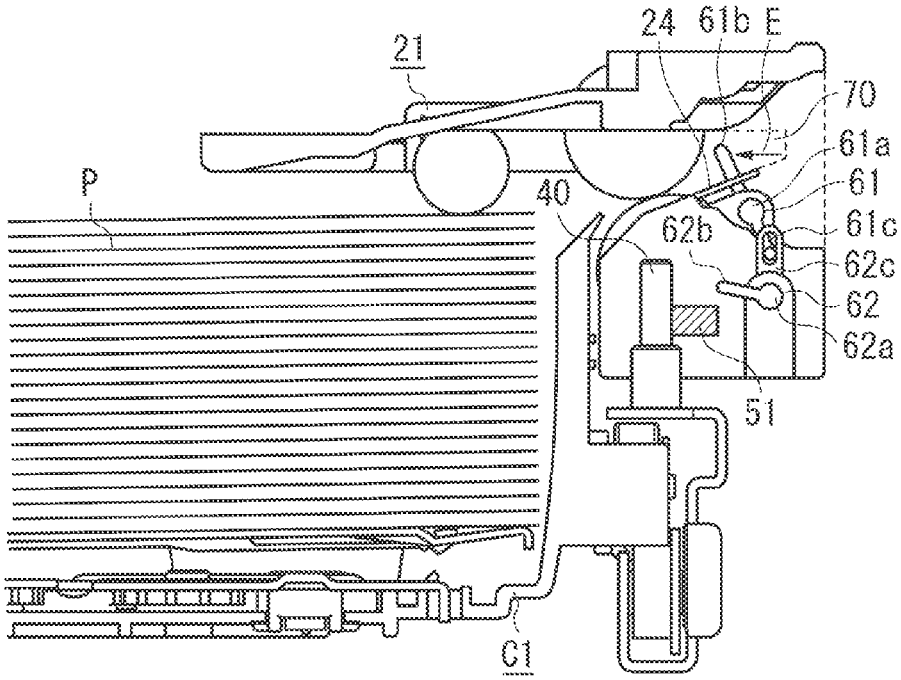
FIGS. 6A and 6B are diagrams each illustrating the example of the sheet conveyance apparatus according to the exemplary embodiment of the present invention.
Figure 6B:
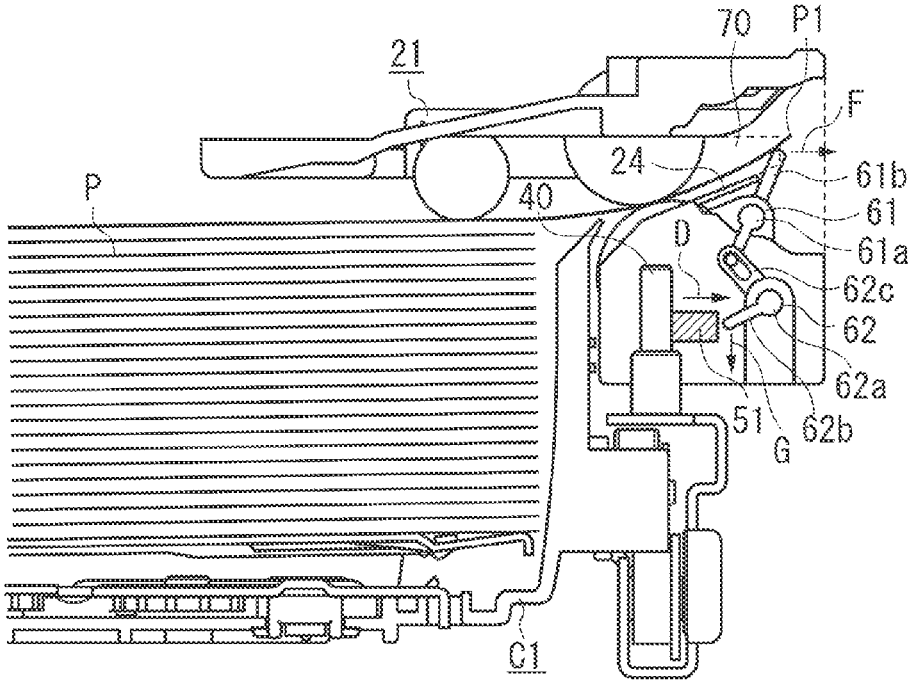

Next, the operation of the restriction mechanism according to the present exemplary embodiment will be described with reference to FIGS. 6A and 6B. FIG. 6A illustrates a case where there is no sheet in the sheet conveyance path, and FIG. 6B illustrates a case where there is a sheet in the sheet conveyance path. In FIG. 6A, the lever member 61 supported to be rotatable around the shaft portion 61*a* is urged in the direction of the arrow E by the urging unit (not illustrated), and the lever portion 61*b* contacts a contact portion 24*a* (illustrated in FIG. 1) of a feeding guide 24 to stop.

On the other hand, as illustrated in FIG. 6B, when the sheet passes the lever portion 61*b*, or when the sheet is at rest at the position of the lever portion 61*b*, the lever portion 61*b* is rotated in the direction of the arrow F by the sheet P1. Then, the stopper member 62 link-connected with the lever member 61 rotates in the direction of the arrow G around the shaft portion 62*a* in conjunction with the rotation of the lever member 61, and the stopper portion 62*b* moves to the restriction position where the rotation of the latch lever 51 in the direction D is restricted. Further, the lever member 61 is provided on the downstream side of the feeding unit 21 and 22 and on the upstream side of the conveyance unit 23. Accordingly, when a sheet exists on the sheet conveyance path at the boundary between the feeding cassette C1 and the conveyance unit 23, it is possible to restrict the rotation of the latch lever 51. That makes it possible to restrict the drawing-out of the feeding cassette C1.

Thus, when the drawing-out of the feeding cassette C1 is restricted, even if the user presses the release button 52, the rotation of the latch lever 51 is restricted by the stopper member 62. Accordingly, it is possible to prevent damage of the apparatus due to the user following the erroneous operational procedures for jamming handling in an attempt to draw out the feeding cassette C1. Further, there is no need to design the stopper member 62 while taking into account the force with which the user draws out the cassette C1, so that it is possible to set the strength of the stopper member 62 at a low level.

As described above, in the present exemplary embodiment, it is possible to restrict the drawing of the feeding cassette out of the apparatus main body, with the sheet remaining while stretching over the feeding cassette C1 or the feeding cassette C2 and the conveyance unit 23. Further, in the present exemplary embodiment, the drawing-out of the feeding cassette is restricted by the stopper member configured to move in conjunction with the rotation of the lever configured to rotate while contacting the sheet passing through the sheet conveyance path. Accordingly, even when the power of the apparatus main body is OFF, it is possible to prevent damage of the sheet due to the user erroneously drawing out the feeding cassette.

Figure 7A:
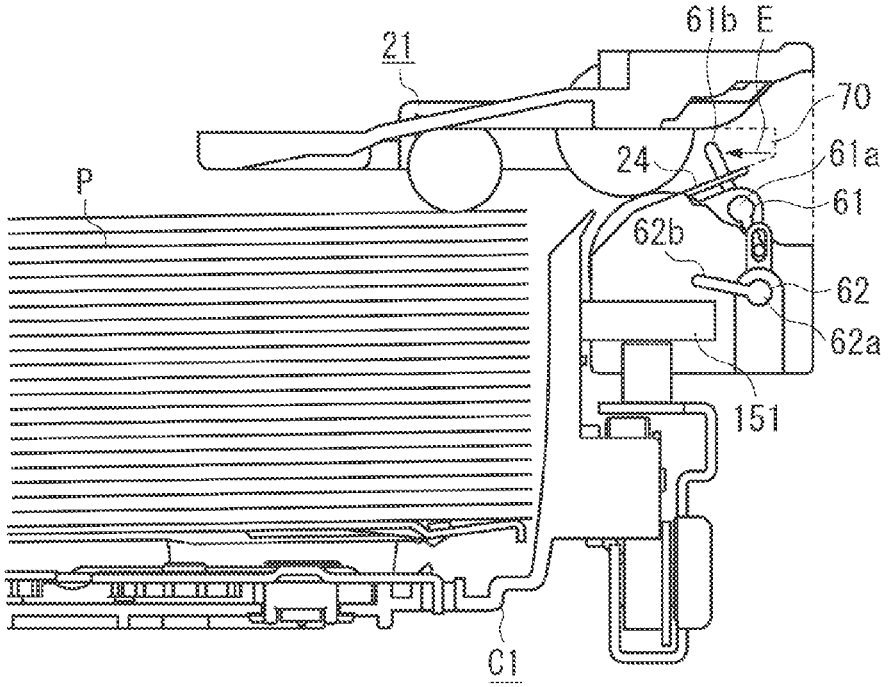
FIGS. 7A and 7B are diagrams each illustrating a modification of the sheet conveyance apparatus according to the exemplary embodiment of the present invention.
Figure 7B:
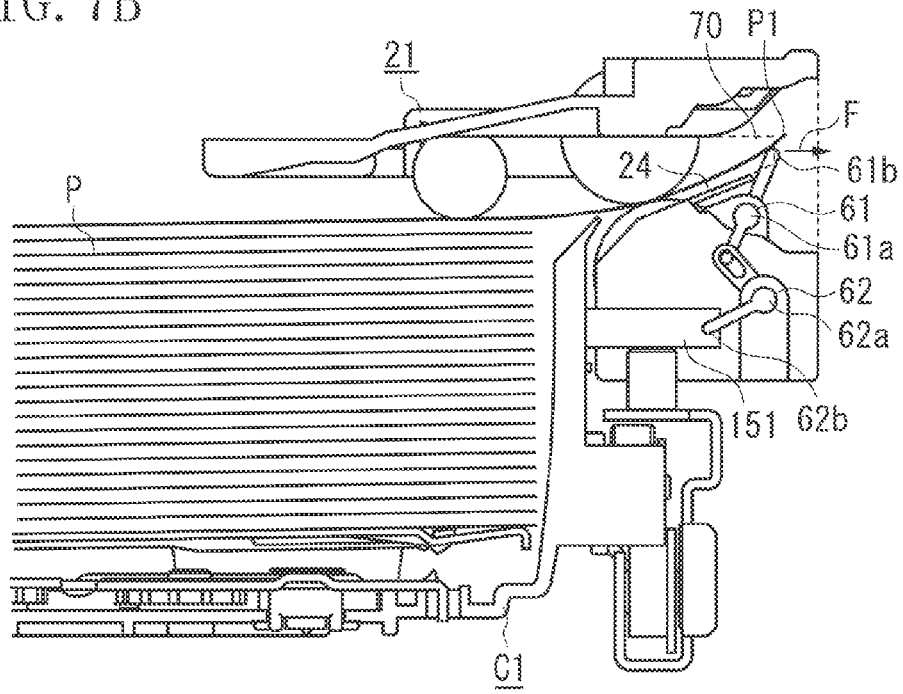

While, in the exemplary embodiment described above, the stopper member 62 restricts the rotation of the latch lever 51, this should not be construed restrictively. It is also possible to directly restrict the drawing-out of the feeding cassette. For example, as illustrated in FIGS. 7A and 7B, in a modification of the present exemplary embodiment, a protrusion 151 may be provided on the outer frame of the feeding cassette C1. As illustrated in FIG. 7B, in the case of this modification, the movement of the feeding cassette C1 in the drawing-out direction may be restricted by causing the stopper member 62 to contact the protrusion 151.

While, in the present exemplary embodiment described above, the lever member is provided on the sheet conveyance path at the boundary portion between the feeding cassette and the conveyance unit, there are no limitations in terms of the position where the lever member is provided so long as the jamming handling processing is not hindered. Further, while the above-described restriction mechanism for restricting the drawing-out of a unit is applied to a feeding cassette, this should not be construed restrictively. The present exemplary embodiment is also applicable to a conveyance unit which can be drawn out and which constitutes a part of a conveyance path for conveying a sheet, such as a transfer unit or a fixing unit. Thus, the present exemplary embodiment also provides its effect when applied to the transfer unit or the fixing unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-286209 filed Dec. 27, 2011, which is hereby incorporated by reference herein in its entirety.

What is claimed is:

1. A sheet conveyance apparatus comprising:

a feeding cassette configured to store a sheet, the feeding cassette being configured to be able to be drawn out of an apparatus main body;

a feeding unit configured to feed the sheet stored in the feeding cassette; a sheet conveyance path provided in the apparatus main body and configured to guide the sheet;

a cover provided on the apparatus main body and configured to be openable and closable and to expose the sheet conveyance path to an exterior by being opened;

a positioning member provided in the apparatus main body; a latch lever provided in the feeding cassette and configured to engage with the positioning member, the latch lever being urged by an urging member such that the latch lever engages with the positioning member;

an operation unit provided in the feeding cassette and configured to be operable from outside of the feeding cassette, when the operation unit is operated, the latch lever moves against an urging force of the urging member, from an engage position at which the latch lever engages with the positioning member to a release position a lever member provided in the sheet conveyance path and configured to rotate by contacting the sheet passing through the sheet conveyance path; and a stopper member configured to rotate to a restriction position to restrict the drawing-out of the feeding cassette, in conjunction with the rotation of the lever member as the sheet contacts the lever member, wherein, when the lever member is rotated by the sheet fed by the feeding unit, the stopper member rotates from a no-restriction position at which the stopper member does not restrict a drawing of the feeding cassette to the restriction position, wherein the latch lever moves in a same direction as a direction in which the feeding unit feeds the sheet when the latch lever moves from the engage position to the release position, and wherein a rotation direction of the stopper member when the stopper member rotates in conjunction with the lever member is an opposite direction to a rotation direction of the lever member.

2. The sheet conveyance apparatus according to claim 1, wherein the feeding cassette is configured to be able to be drawn out in a direction crossing a sheet feeding direction of the feeding unit.

3. The sheet conveyance apparatus according to claim 1, wherein the operation unit includes a release button configured to release the engagement between the latch lever and the positioning member when the release button is pressed.

4. An image forming apparatus configured to form an image on a sheet, the image forming apparatus comprising:

the sheet conveyance apparatus according to claim 1; and an image forming unit configured to form an image on a sheet.

5. The sheet conveyance apparatus according to claim 1, wherein the stopper member is link-connected with the lever member.

6. The sheet conveyance apparatus according to claim 1, wherein the lever member includes a lever portion provided at one end side of the lever member and protruding into a sheet conveyance path and a connection portion provided at other end side of the lever member and connected with the stopper member, the sheet conveyance apparatus comprising:

a hole into which the connection portion is inserted, wherein the stopper member and the lever member are rotatable around different shafts, and wherein the lever member rotates and the connection portion moves in the hole so that the stopper member rotates in a direction opposite to a direction in which the lever member rotates.

* * * * *